US007618354B2

(12) United States Patent
Wu

(10) Patent No.: US 7,618,354 B2
(45) Date of Patent: Nov. 17, 2009

(54) STEPPING EXERCISE APPARATUS

(76) Inventor: Shiou-Jhen Wu, No. 18, Lane. 57, Taipei County, Banciao City (TW)

( * ) Notice: Subject to any disclaimer, the term of this patent is extended or adjusted under 35 U.S.C. 154(b) by 133 days.

(21) Appl. No.: 12/020,517

(22) Filed: Jan. 26, 2008

(65) Prior Publication Data

US 2009/0192024 A1 Jul. 30, 2009

(51) Int. Cl.
*A63B 22/06* (2006.01)
*A63B 22/04* (2006.01)

(52) U.S. Cl. ..... 482/60; 482/57; 482/52

(58) Field of Classification Search ..... 482/51–53, 482/57–65, 904, 148; 52/126.1, 749.12; 182/45; 248/148
See application file for complete search history.

(56) References Cited

U.S. PATENT DOCUMENTS 3,259,385 A * 7/1966 Boren ..... 482/60
3,622,153 A * 11/1971 Thompson ..... 482/60
3,968,963 A * 7/1976 Sileo ..... 482/57
4,640,301 A * 2/1987 Battiston et al. ..... 135/67
4,805,901 A * 2/1989 Kulick ..... 482/63
4,838,547 A * 6/1989 Sterling ..... 482/128
4,971,317 A * 11/1990 Link ..... 482/57
4,973,046 A * 11/1990 Maxwell ..... 482/60
4,974,840 A * 12/1990 Welch ..... 482/133

* cited by examiner

*Primary Examiner*—Steve R Crow
(74) *Attorney, Agent, or Firm*—Banger Shia

(57) ABSTRACT

A stepping exercise apparatus includes a body, a crank pedal mechanism and a foot support device. The crank pedal mechanism is mounted in the body and includes a crank shaft and two pedals mounted respectively on two ends of the crank shaft. The foot support device is connected to the body to support and includes two feet, two positioning locks and two stabilizer bars. The feet are respectively and pivotally connected to body between a folded position and an unfolded position. The positioning locks are respectively mounted between the body and the feet to respectively lock the feet with the body when the feet are respectively kept in the unfolded position. The stabilizer bars are respectively and transversely connected to the feet.

6 Claims, 5 Drawing Sheets

STEPPING EXERCISE APPARATUS

BACKGROUND

1. Field of the Invention

The present invention relates to a stepping exercise apparatus. More particularly, the present invention relates to a stepping exercise apparatus with collapsible stabilizer bars and may be favorable for rehabilitation purposes.

2. Description of Related Art

Step-type exercise machines are developed for the exerciser to exercise under a predetermined load so as to improve physical strength or to perform rehabilitation of the exerciser. Recently, various types of step-type exercise machines have been developed for training, exercising or rehabilitation. For example, a kind of exercise machine provides a pair of right and left crank pedals that can be mutually driven up and down. Stepping down on the right pedal simultaneously lifts the left pedal up through the connected crank and vice versa.

A conventional step-type exercise machine comprises a body, a pair of crank pedals and a foot support device. The foot support device stabilizes the exercise machine on a flat surface, such as the ground or floor while the exerciser steps on the pedals to exercise. Typically, the foot support device is extended from the body and has transverse bars that can be located on the flat surface to stabilize the entire machine. Thus, the conventional foot support device occupies a large space for storage, package or transportation of the exercise machine because of the transverse stabilizer bars.

Therefore, there is a need to provide an improved stepping exercise apparatus to mitigate or obviate the aforementioned problems.

SUMMARY

An object of the present invention is to provide a stepping exercise apparatus with collapsible supporting feet to firmly stabilize the entire apparatus while exercising and save space of storage, transportation or package.

A stepping exercise apparatus in accordance with the present invention comprises a body, a display device, a load adjustment device, a crank pedal mechanism and a foot support device.

The body comprises two inclined segments connected at a jointing portion, two pivoting brackets and a through hole transversely defined in the jointing portion. Each of the inclined segments has a distal end onto which one of the pivoting brackets is connected. The display device is mounted in the body to show exercise data. The load adjustment device is mounted in the jointing portion of the body to adjust the load of the pedals. The crank pedal mechanism connects to the jointing portion of the body and comprises a crank shaft and two pedals. The crank shaft is partially and rotatably mounted in the through hole and has two ends onto which the pedals are connected.

The foot support device is connected to the body and comprises two feet, two positioning locks and two stabilizer bars. The feet are respectively and pivotally connected to the pivoting brackets between a folded position and an unfolded position. The positioning locks are respectively mounted between the pivoting brackets and the feet to respectively lock the feet with the pivoting brackets when the feet are respectively kept in the unfolded position. The stabilizer bars are respectively and transversely connected to the feet.

In an embodiment, each of the feet has a pin hole with a neck. Each of the pivoting brackets has a locking hole corresponding to the pin hole. Each of the positioning locks comprises a locking pin, a releasing ring and a resilient member. The locking pin is movably mounted and held in the pin hole and has a shoulder and an outside end extending out of the pin hole to engage the locking hole when the feet are respectively kept in the unfolded position. The releasing ring is connected to the locking pin. The resilient member is mounted in the pin hole between the neck and the shoulder.

When the exercise apparatus is needed to store, transport or package, pulling the locking pin backwards through the releasing ring enables the outside end of the locking pin disengaging the locking hole so that the feet can be collapsed to save space of storage, transportation or package.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
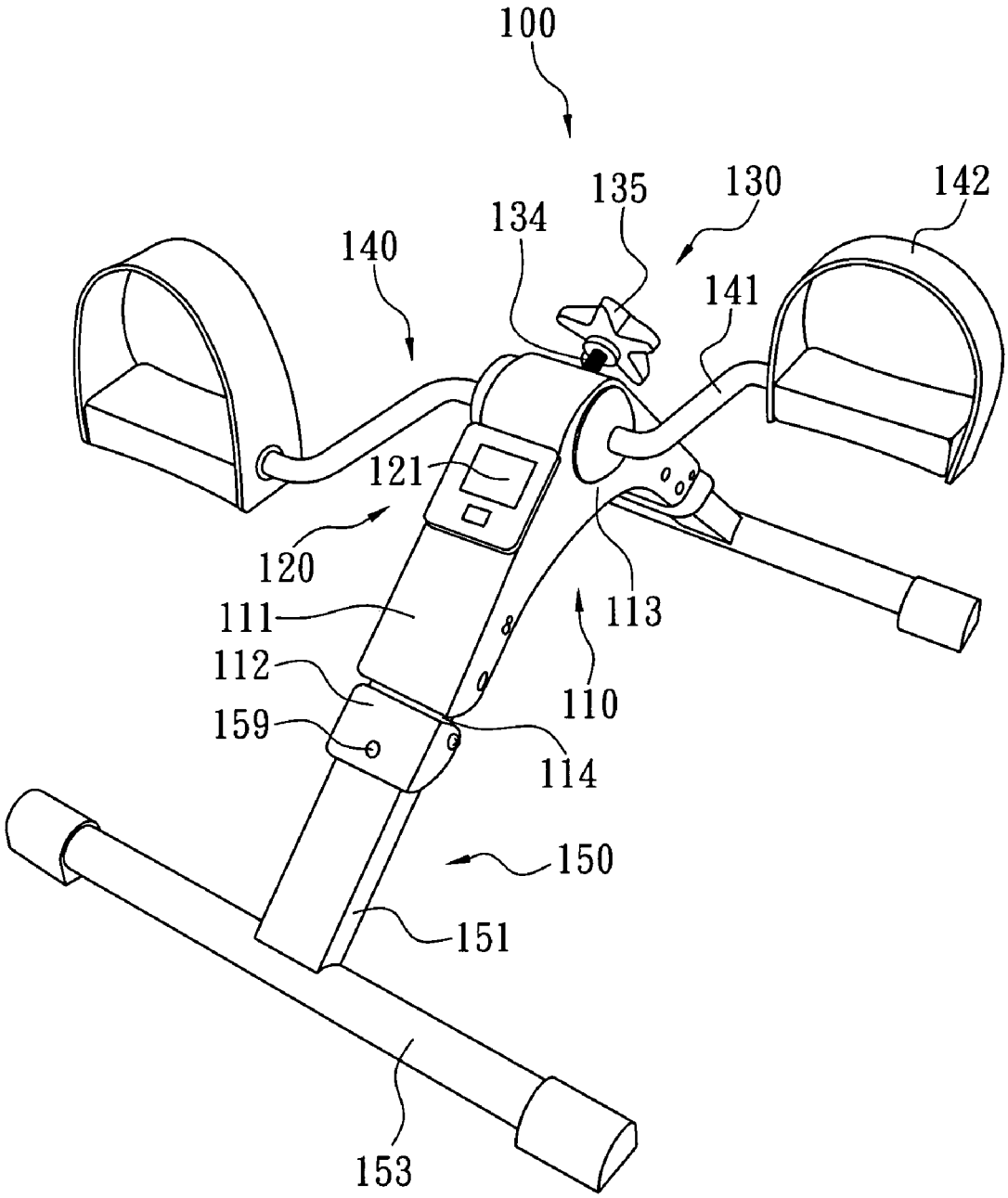
FIG. 1 is a perspective view of an embodiment of a stepping exercise apparatus in accordance with the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
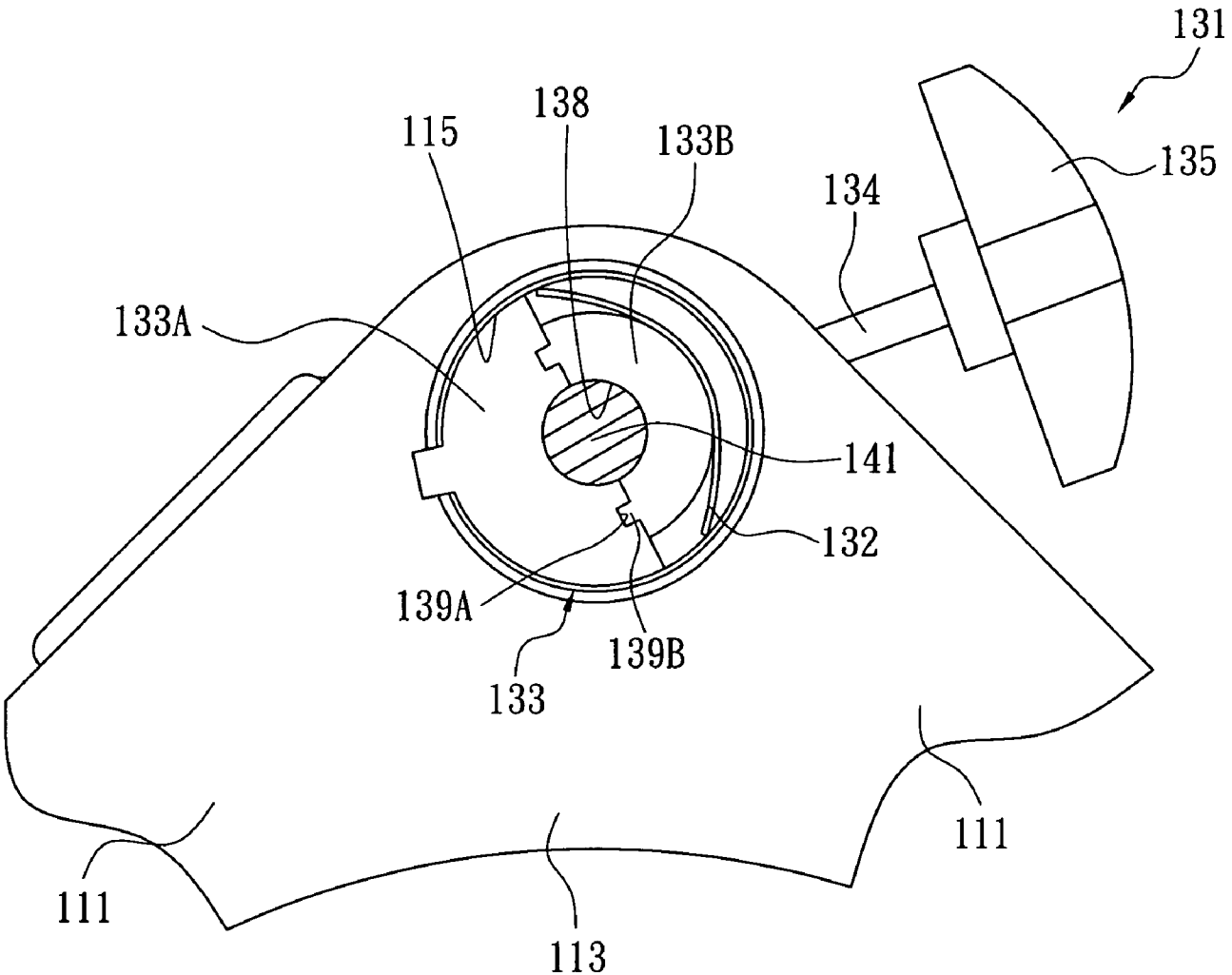
FIG. 2 is a partial side view in partial section of the stepping exercise apparatus in FIG. 1.

Refer to FIG. 1 and FIG. 2. A stepping exercise apparatus 100 of an embodiment in accordance with the present invention comprises a body 110, a display device 120, a load adjustment device 130, a crank pedal mechanism 140 and a foot support device 150. The display device 120 is mounted on the body 110 to show the exercise data such as the revolutions, the distance and the speed when the exerciser is exercising. The load adjustment device 130 is mounted in the body 110 so that the exerciser can gradually adjust the load of the crank pedal mechanism 140 to exercise. The foot support device 150 supports and stabilizes the body 110 on a flat surface, such as the ground or floor.

The body 110 comprises two inclined segments 111 and two pivoting brackets 112. The inclined segments 111 are connected integrally at a jointing portion 113 and have an included angle between them. Each of the inclined segments 111 has a distal end 114. The pivoting brackets 112 are respectively connected to the distal ends 114 of the inclined segments 111. Further, the body 110 has a through hole 115 defined transversely in the jointing portion 113.

Figure 3:
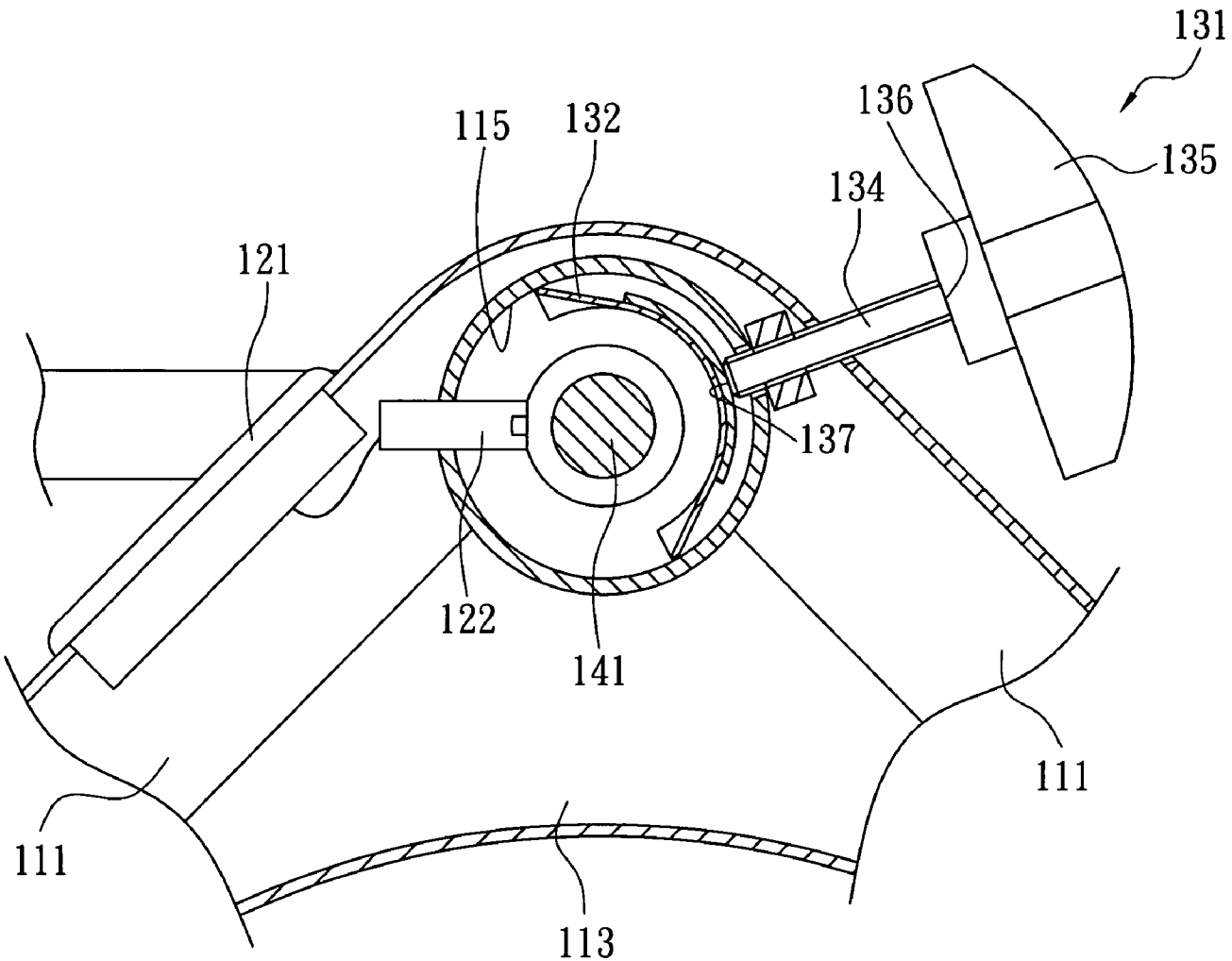
FIG. 3 is a partial section side view of the stepping exercise apparatus in FIG. 1.

Further refer to FIG. 3. The display device 120 is mounted on one of the inclined segments 111 and comprises a display panel 121 and a sensor 122. The display panel 121 is mounted on the inclined segment 111 to show the exercising data when the exerciser is exercising. The sensor 122 is mounted in the body 110 and extended into the through hole 115 of the body 110 to sense the revolutions of the crank pedal mechanism 140. The sensor 122 is electrically connected to the display panel 121 and may be a magnetic sensor to sense the revolutions through the magnetic approach.

The load adjustment device 130 is mounted on the body 110 adjacent to the jointing portion 113 and comprises an adjusting member 131, an intermediate piece 132 and a frictional cylinder 133. The adjusting member 131 is rotatably mounted in the body 110 and comprises a threaded shaft 134 and a knob 135. The knob 135 is connected to a first end 136 of the threaded shaft 134, and a second end 137 of the threaded shaft 134 is screwed into the body 110 and abuts against the intermediate piece 132.

The intermediate piece 132 is mounted in the through hole 115 of the body 110 between the second end 137 of the threaded shaft 134 and the frictional cylinder 133. The intermediate piece 132 may comprise one or more than one pieces. In the embodiment, the intermediate piece 132 comprises two flexible pieces.

The frictional cylinder 133 mounted in the through hole 115 of the body 110 and comprises a crank hole 138, a first semicircular block 133A and a second semicircular block 133B. The first semicircular block 133A has multiple recesses 139A. The second semicircular block 133B has multiple protrusions 139B respectively held in the recesses 139A to position the semicircular blocks 138A, 138B without relative motions.

The crank pedal mechanism 140 comprises a crank shaft 141 and two pedals 142. The crank shaft 141 is partially and rotatably mounted in the crank hole 138 with its two ends respectively extended out of the body 110 onto which the pedals 142 are respectively connected. Thus, rotating the adjusting member 131 enables the second end 137 of the threaded shaft 134 to move inwardly to push the intermediate piece 132 and to squeeze the crank shaft 141 with the semicircular blocks 138A, 138B so as to increase the frictional load, or move outwardly to leave the intermediate piece 132 to loose the semicircular blocks 138A, 138B so as to decrease frictional load.

Figure 4:
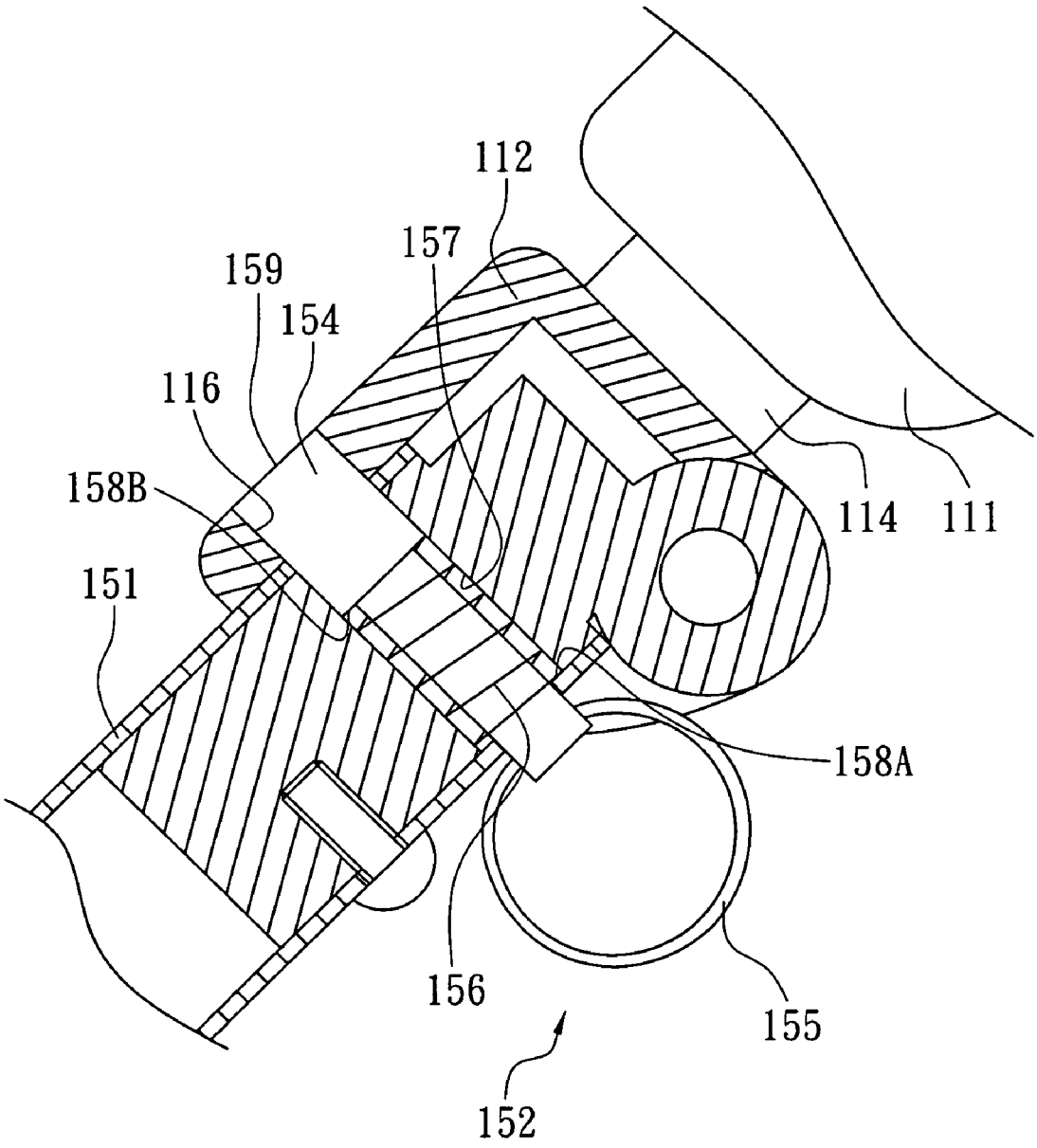
FIG. 4 is a partial side view in partial section of a positioning lock of the stepping exercise apparatus in FIG. 1.
Figure 5:
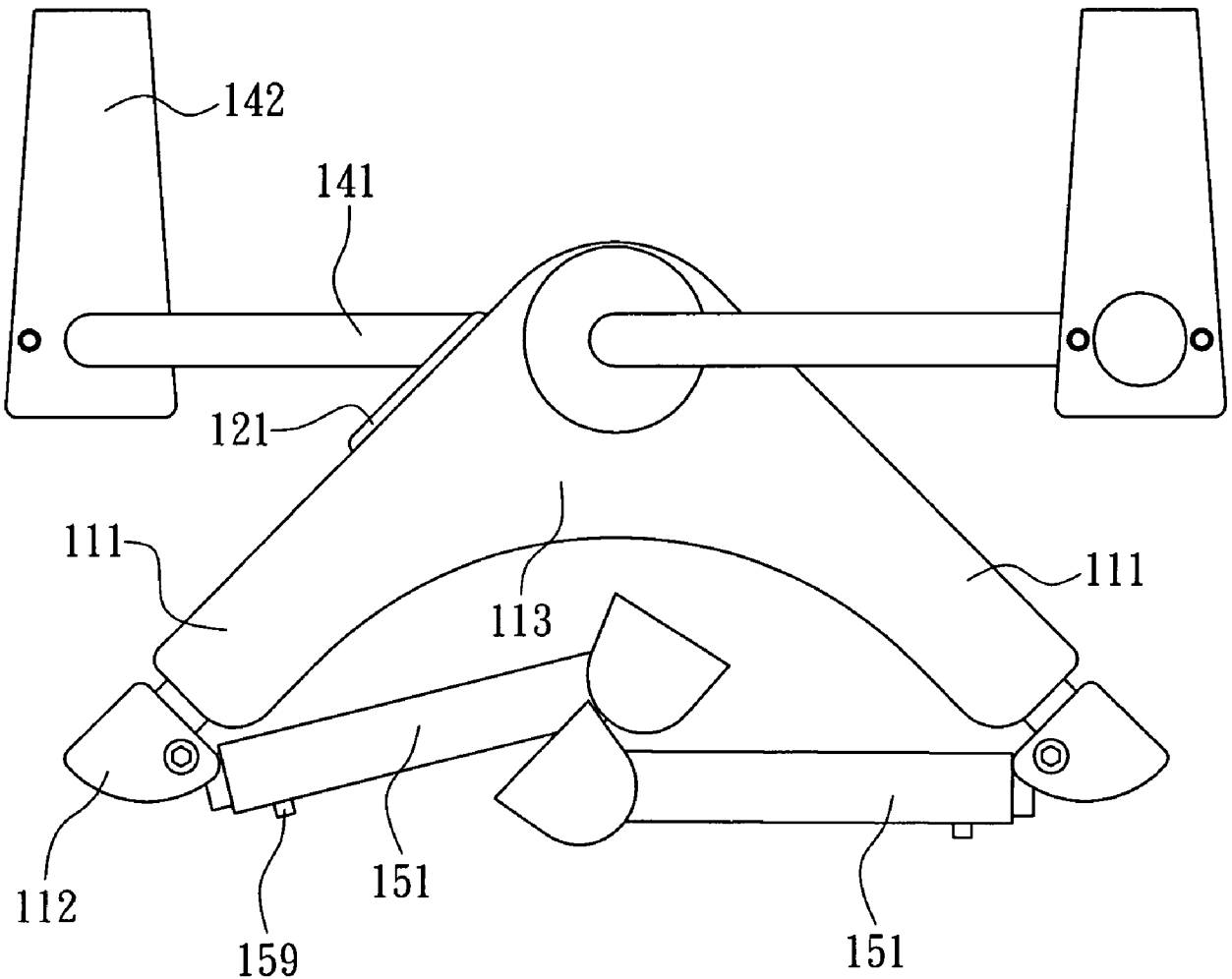
FIG. 5 is a perspective view of the stepping exercise apparatus in FIG. 1 when the stepping exercise apparatus are collapsed.

Refer to FIG. 1, FIG. 4 and FIG. 5. The foot support device 150 comprises two feet 151, two positioning locks 152 and two stabilizer bars 153. The feet 151 are respectively and pivotally connected to the pivoting brackets 112 between a folded position (as shown in FIG. 5) and an unfolded position (as shown in FIG. 1). The positioning lock 152 is mounted between the pivoting bracket 112 and the foot 151 and comprises a locking pin 154, a releasing ring 155 and a resilient member 156. Further, the foot 151 has a pin hole 157, and the pivoting bracket 112 has a locking hole 116 corresponding to the pin hole 157. The pin hole 157 has a neck 158A. The locking pin 154 is movably mounted and held in the pin hole 157 and has a shoulder 158B and an outside end 159. The outside end 159 extends out of the pin hole 157. The releasing ring 155 is connected to the locking pin 154 at the other end opposite to the outside end 159. The resilient member 156 may be a spring and is mounted in the pin hole 157 around the locking pin 154 between the neck 158A and the shoulder 158B. The stabilizer bars 153 are respectively and transversely connected to the feet 151.

When using the exercise apparatus 100, the feet 151 are pivoted relative to the pivoting bracket 112 until the outside end 159 of the locking pin 154 engages the locking hole 116. Thus, the feet 151 are positioned and locked on the pivoting bracket 112 to firmly support and stabilize the entire exercise apparatus 100 with the stabilizer bars 153 for exercise as shown in FIG. 1.

When the exercise apparatus 100 is needed to store, transport or package, pulling the locking pin 154 backwardly through the releasing ring 155 enables the outside end 159 of the locking pin 154 disengaging the locking hole 116 so that the feet 151 can be collapsed to save space of storage, transportation or package as shown in FIG. 5.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A stepping exercise apparatus comprising:

a body comprising two inclined segments connected at a jointing portion, two pivoting brackets and a through hole transversely defined in the jointing portion, and each of the inclined segments having a distal end onto which one of the pivoting brackets is connected;

a display device mounted in the body;

a load adjustment device mounted in the jointing portion of the body;

a crank pedal mechanism connected to the jointing portion of the body and comprising a crank shaft and two pedals, and the crank shaft partially and rotatably mounted in the through hole and having two ends onto which the pedals are connected;

a foot support device connected to the body and comprising two feet respectively and pivotally connected to the pivoting brackets between a folded position and an unfolded position;

two positioning locks respectively mounted between the pivoting brackets and the feet to respectively lock the feet with the pivoting brackets when the feet are respectively kept in the unfolded position; and two stabilizer bars respectively and transversely connected to the feet.

2. The stepping exercise apparatus as claimed in claim 1, wherein each of the feet has a pin hole with a neck;

each of the pivoting bracket has a locking hole corresponding to the pin hole; and each of the positioning locks comprises:

a locking pin movably mounted and held in the pin hole and having a shoulder and an outside end extending out of the pin hole to engage the locking hole when the feet are respectively kept in the unfolded position;

a releasing ring connected to the locking pin; and a resilient member mounted in the pin hole between the neck and the shoulder.

3. The stepping exercise apparatus as claimed in claim 1, wherein the display device comprises a display panel, and a sensor electronically connected to the display panel, mounted in the body and extended into the through hole.

4. The stepping exercise apparatus as claimed in claim 3, wherein the sensor is a magnetic sensor to sense revolutions of the crank shaft.

5. The stepping exercise apparatus as claimed in claim 1, wherein the load adjustment device comprises:

an adjusting member rotatably mounted in the body and comprising a threaded shaft and a knob, the threaded shaft having a first end and a second end, and the first end connected to the knob and the second end screwed into the through hole;

a frictional cylinder mounted in the through hole and comprising a crank hole to partially and rotatably hold the crank shaft; and an intermediate piece mounted in the through hole between the second end of the threaded shaft and the frictional cylinder.

6. The stepping exercise apparatus as claimed in claim 5, wherein the frictional cylinder comprises:

a first semicircular block having a plurality of recesses; and a second semicircular block having a plurality of protrusions respectively held in the recesses to position the first and the second semicircular blocks without relative motions in the through hole.

* * * * *